United States Patent [19]

Kittredge

[11] 4,421,023

[45] Dec. 20, 1983

[54] PRINTER CONTROL SYSTEMS FOR ELECTRONIC POSTAGE METER

[75] Inventor: Lloyd G. Kittredge, Trumbull, Conn.

[73] Assignee: Pitney Bowes Inc., Stamford, Conn.

[21] Appl. No.: 380,206

[22] Filed: May 20, 1982

[51] Int. Cl.[3] ..... B41J 3/44

[52] U.S. Cl. ..... 101/45; 101/72; 101/91

[58] Field of Search ..... 101/72, 74, 76, 106, 101/109–116, 45; 400/663, 664, 666, 668, 676–677

[56] References Cited

U.S. PATENT DOCUMENTS

| | | | |
|---|---|---|---|
| 3,823,666 | 7/1974 | Hanson | 101/91 |
| 3,916,785 | 11/1975 | Burger et al. | 101/45 |
| 3,978,457 | 8/1976 | Check, Jr. et al. | 101/91 |
| 4,050,374 | 9/1977 | Check, Jr. | 101/91 |
| 4,140,054 | 2/1979 | Martin et al. | 101/91 |
| 4,256,036 | 3/1981 | Sauerwein | 101/45 |
| 4,259,902 | 4/1981 | Eckert, Jr. et al. | 101/91 |
| 4,287,825 | 9/1981 | Ecuert, Jr. et al. | 101/91 |
| 4,321,867 | 3/1982 | Soderberg | 101/91 |
| 4,331,075 | 5/1982 | Williams | 101/91 |
| 4,345,521 | 8/1982 | Soderberg et al. | 101/45 |

*Primary Examiner*—E. H. Eickholt

*Attorney, Agent, or Firm*—Robert E. Meyer; William D. Soltow, Jr.; Albert W. Scribner

[57] ABSTRACT

In an electronic postage meter, the setting motors for setting the print wheels in the printing drum are directly controllable externally of the secure portion of the meter. The meter includes a shutter bar arranged to block rotation of the printing drum under determined conditions, the printing drum being rotatable in response to drive from a postage meter base. The postage meter includes first and second interposers controlled by a microprocessor for redundantly inhibiting movement of the shutter bar from a position blocking printing of postage. One of the microprocessor controlled interposers is also mechanically coupled to the print wheel setting mechanism to inhibit release of the interposer at determined positions of the stepping mechanism, and to inhibit operation of the setting mechanism when the interposer is released.

14 Claims, 7 Drawing Figures

PRINTER CONTROL SYSTEMS FOR ELECTRONIC POSTAGE METER

This invention relates to electronic postage meters, and is more particularly directed to a control system for blocking the operation of the printing mechanism of the postage meter, in redundant manner, to prevent the unauthorized printing of postage.

U.S. Pat. No. 4,287,825 of Eckert, Jr. et al., discloses a printing control system for an electronic postage meter, wherein the print wheels of a postage meter are separately set by a master gear, under the control of a stepping motor, at different positions of a carriage being controlled by a further stepping motor. In this postage meter, the printing drum is rotatable in response to the rotation of a drive gear on a postage meter base, such as disclosed, for example, in U.S. Pat. No. 2,934,009. Since the printing drum is thus rotated by external mechanical power, it is necessary to insure that printing operations do not occur, in response to such external drive, unless the postage printed can by accurately accounted for. For this purpose, a shutter bar is provided extending into a slot in the driven gear of the postage meter, the shutter bar being controllable by a pair of interposers or catches. The two interposers enable redundant control over the shutter bar, in order to insure the security of the postage meter. The operation of the interposers may be controlled, for example, as disclosed in U.S. Pat. No. 4,302,821 of Eckert, Jr. et al., in response to errors or false conditions in the operation of, or at improper times in the operation of the meter. In the printing control system disclosed in U.S. Pat. No. 4,287,825, the second interposer is controlled at the "home" position of the master gear, in response to operation of the corresponding stepping motor.

This arrangement is satisfactory in the type of postage meter disclosed therein, since the stepper motors for controlling the print wheels are controlled by the electronic control system within the postage meter itself, such that the stepper motors cannot be directly controlled by external means. As a consequence, the electronic control system, which may be a microcomputer system, also controls the second interposer on a redundant basis.

In modified electronic postage meter systems, however, it is desirable to be able to directly control the stepper motors by an external control system, in order, for example, to simplify the electronic postage meter and minimize the number of components within the postage meter.

When the power for stepping the stepper motors is directly controllable externally of the postage meter, it is evident that the stepper motors themselves may be positioned without control by the security systems within the postage meter. Since the second interposer of U.S. Pat. No. 4,287,825 is directly under the control only of the stepper motors, it is then apparent that the design of the meter to employ a separate power pack enables the defeat of the second interposer, and hence the loss of redundancy. As a consequence, malfunctioning of the first interposer may enable the unauthorized printing of postage without accounting.

The present invention is therefor directed to the provision of a printing control system for an electronic postage meter that overcomes the above disadvantages of the prior systems.

Briefly stated, in accordance with the invention, the second or auxiliary interposer is controlled, for example, by a solenoid within the postage meter, under the control of the microcomputer control systems of the postage meter. The auxiliary interposer, in this instance, may thus not be moved into and out of locking position by the stepper motor. In addition, the control for the auxiliary interposer also controls a cam lock, the cam lock being positioned with respect to the carriage of the setting mechanism such that the auxiliary interposer may only be released in the "home" position of the setting mechanism. With this arrangement, external control of the stepper motors cannot be directly employed to defeat the auxiliary interposer.

In a further feature of the invention, an alignment pin is mounted to engage the teeth of the master gear in the "home" position thereof, in order to ensure the proper alignment of the master gear. This overcomes the problem that could occur for example, if the corresponding stepper motor shifted in position as a result of dropping the postage meter or the like. The proper alignment of the master gear at its home position ensures that the gear will not jam when it is moved to engage the print wheel setting gears.

In order that the invention will be more clearly understood, it will now be disclosed in greater detail with reference to the accompanying drawings, wherein.

Figure 1:
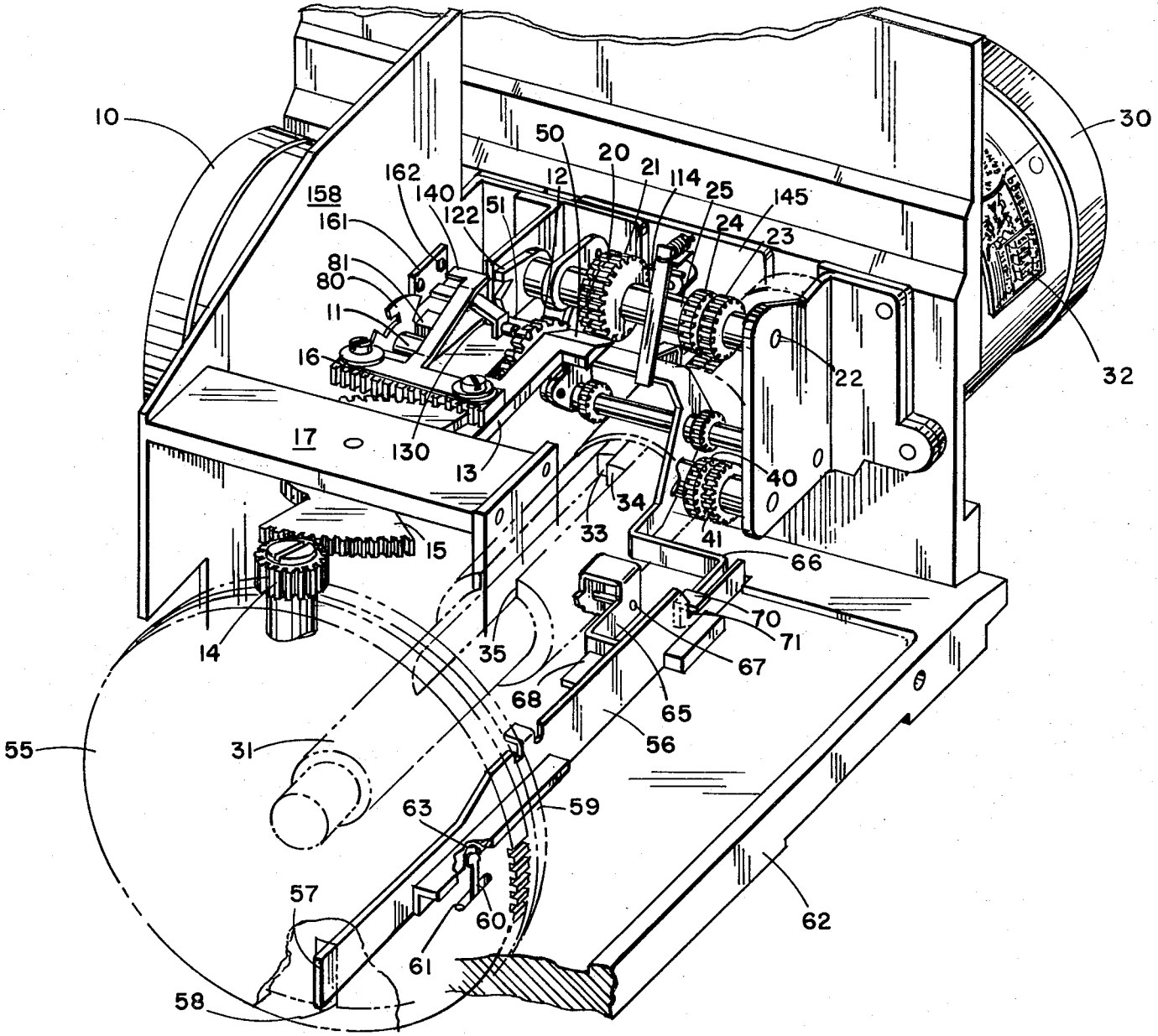
FIG. 1 is a perspective view of the setting mechanism of an electronic postage meter, in accordance with the invention.

Referring now to the drawings, and more in particular to FIG. 1, therein is illustrated a perspective view of a portion of an electronic postage meter of the type to which the present invention is concerned. The electronic portion of the system, which is not disclosed therein, may be of the type, for example, as disclosed in U.S. Pat. No. 3,978,457. The mechanical portion of the postage meter, as illustrated in FIG. 1, constitutes a modification of a similar system disclosed in U.S. Pat. No. 4,287,825.

As illustrated in FIG. 1, a stepper motor 10 mounted on a suitable frame rotates a spline shaft 11. The spline shaft carries a master gear 12. The master gear 12 is carried for axial movement along the shaft in a carriage 13. The carriage is moved by a further stepping motor (not shown) by way of a pinion gear 14, a butterfly gear 15 and a rack 16 affixed to the carriage. The butterfly gear 15 is pivotably mounted in a frame member 17.

The master gear 12 is selectively, axially moveable for engagement with gears 20 and 21 mounted co-axial with shaft 22. The gears 20 and 21 are mounted to rotate gears 23 and 24, respectively, also co-axial with the axis 22. For example, an outer, co-axial shaft 25 may interconnect the gears 21 and 24, while an inner co-axial shaft (not shown) interconnects gears 20 and 23. The axis 22 is, of course, parallel to the spline shaft 11.

The postage meter further includes a printing drum 30 rotatable by a drum shaft 31, and carrying a plurality of print wheels 32. The print wheels 32 are selectively set by racks 33 and 34 slidably mounted in an axially extending slot 35 up on the drum shaft. Consequently, the carriage 13 may be stepped, by its stepping motor, to enable the selective stepping of the gears 20 and 21 by the stepping motor 10 thereby to enable the selective setting of two of the print wheels 32. Additional racks (not shown) for controlling further print wheels are provided on the underside of the drum shaft 31, selectively controllable by gears 40 and 41, with further gears on co-axial shafts coupled with the gears 40 and 41, enabling selective control thereof at further step carriage positions of the master gear 12. Consequently, the print wheels 32 may be sequentially set by selectively moving the carriage to align the master gear with each of the setting gears, such as the setting gears 20 and 21, and then stepping the stepping motor the desired number of positions.

The carriage 13 carries a pair of tooth profiles 50 and 51 on opposite sides of the master gear 12, and positioned to engage the teeth of the stepping gears 20 and 21 when the master gear 12 is not engaged therewith. These teeth profiles hence prevent movement of the print wheels 32, except when the master gear engages the respective stepping gear 20 or 21. A similar set of tooth profiles (not shown) is provided for engagement with the stepping gears (not shown) which are coupled to the gears 40 and 41.

The postage meter illustrated in FIG. 1 is of the type adapted to be mounted upon a base, with mechanical drive for rotating the drive gear 55 being derived from the base. A suitable drive base for this purpose is disclosed, for example, in aforementioned U.S. Pat. No. 2,934,009. The drive gear 55 is affixed to one end of the drum shaft 31, for rotating the print drum 30.

A shutter bar 56 is slidably mounted within the postage meter for movement into and out of a position to inhibit or block rotation of the drive gear 55. In the blocking position, as illustrated in FIG. 1, one end 57 of the shutter bar projects into a slot 58 in a plate 59 axially spaced from and securely fastened to the drive gear 55. The shutter bar end 57 projects through the slot 58 and into the space between the plate 59 and the drive gear 55. In this position of the shutter, the drive gear 55 is blocked or inhibited from rotating the print drum 30, thereby inhibiting the printing of postage or other information.

The shutter bar 56 is movable into and out of the illustrated blocking position by a shutter bar lever 60. The shutter bar lever 60 is a portion of the postage meter drive base, as above discussed, to which the postage meter of FIG. 1 is detachably mounted. The shutter bar lever 60 projects through an opening 61 in the bottom 62 of the postage meter frame to nest in a notch 63 in the shutter.

Movement of the shutter bar 56 within the postage meter is inhibited by two interposers 65 and 66. The interposer 65 is pivotally mounted at a pivot 67 and positioned to engage a shoulder 68 affixed to the shutter bar 56, thereby to inhibit withdrawal of the shutter bar from the slot 58 at one pivotal position of the interposer 65. The interposer 66 is pivotally mounted on the axis of shaft 11, and has an extension 70 abutting a shoulder 71 of the shutter bar at one pivotal position, thereby to also inhibit withdrawal of the shutter bar from the slot 58 at this position of the interposer 66.

In order to enable determination of the stepping position of the stepping motor 10, a slotted disc 80 is provided on the shaft of the stepping motor 10, and cooperating with an optical detector 81, for example, a two-channel LED photodetector combination, so that the number of pulses output from the detector 81 is indicative of the setting position of the print wheel being set at any given time.

The portion of the postage meter described thus far is the same as that of the aforementioned U.S. Pat. No. 4,287,825 of Eckert, Jr. et al., for a Printing Control System.

In an electronic postage meter of one type, the printing arrangement such as illustrated in FIG. 1 and a microprocessor accounting system are enclosed in a common secure housing adapted to be separated from a power pack. This arrangement minimized the number of components that must be employed within the secure housing, thereby rendering the postage meter more economical and easier to fabricate.

Figure 2:
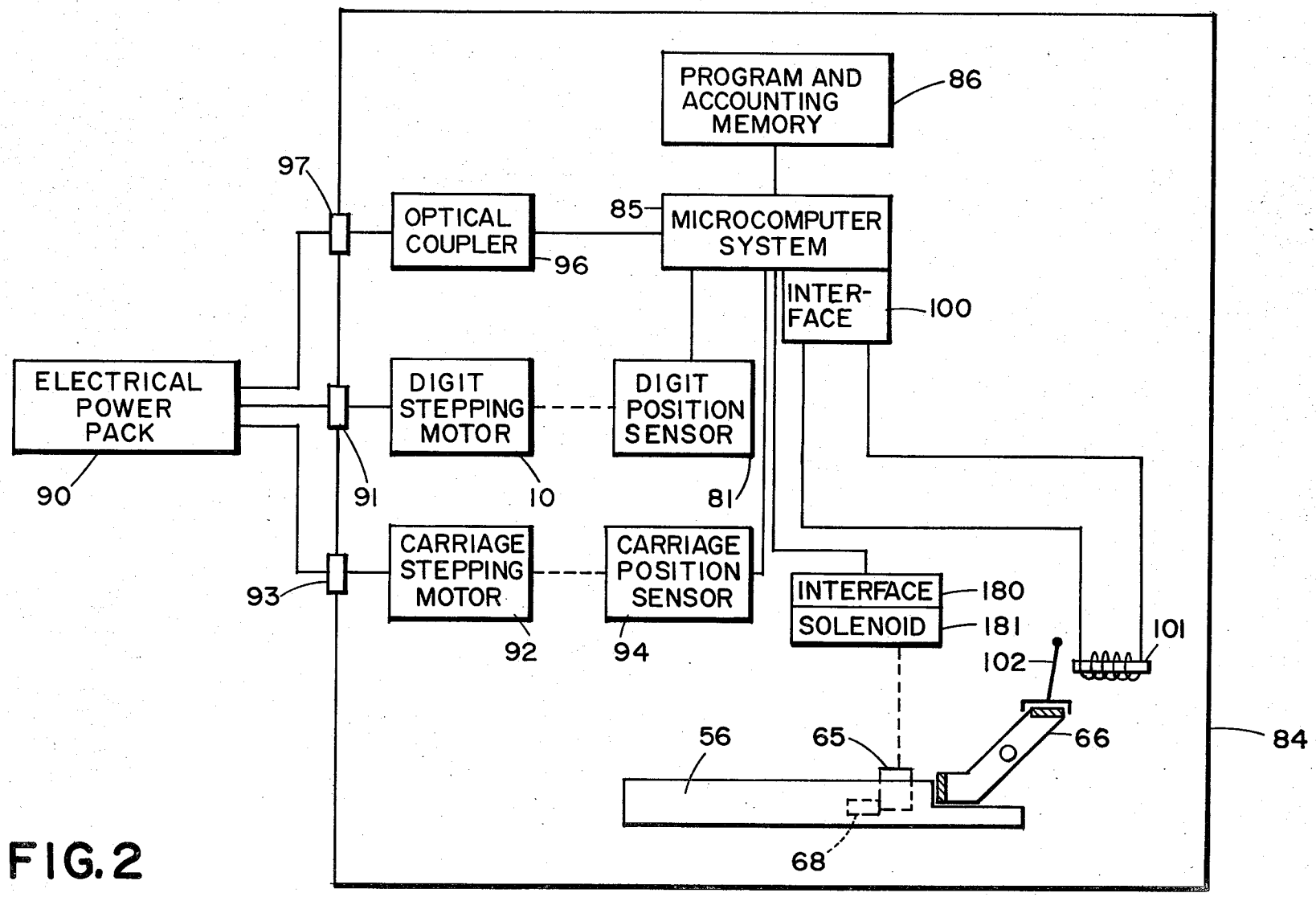
FIG. 2 is a block diagram of the electronic control system for the auxiliary interposer control in accordance with the invention.

FIG. 2 is an electrical block diagram of an electronic postage meter system of the type wherein the electric power pack is physically outside of the secure housing portion itself, for example, for recharging purposes. As illustrated in FIG. 2, the accounting and printing circuitry of the postage meter are enclosed within a secure housing 84 and include a microcomputer 85 having a memory 86 including program memory for postage meter operations, and an accounting and working memory, which may include, for example, a non-volatile memory. The digit stepping motor 10 is controlled by an electrical power pack 90 external of the secure housing, and connected thereto by way of a conventional separable connector 91. The carriage stepping motor 92, for positioning the carriage circuiting of FIG. 1, is similarly controlled by the external power pack 90, connected to a stepping motor 92 by way of a removable connector 93. The positions of the digit stepping motor and carriage stepping motor are sensed by the sensors 81 and 94 respectively, the sensors being coupled to the microcomputer 85 for verification of the positions of the mechanical elements by the microcomputer. In addition, a position sensor 95 is coupled to the microcomputer 81 for indicating the position of the shutter bar 56.

In order to ensure that postage is not printed by the postage meter that is not accounted for in the electronic accounting system, it is necessary to ensure that the print drum 30 is not rotated at improper times in the operating cycle, and it is for this purpose that the interposer 65 and auxiliary interposer 66 have been provided. The interposer 66 of FIG. 1 may be controlled by the microcomputer 85 of FIG. 2, for example, by means of a solenoid such as disclosed in aforementioned U.S. Pat. No. 4,287,825, and U.S. Pat. No. 4,253,015 of Robert B. McFiggans and Alton B. Eckert, Jr. The interposer 66 is provided in order to maintain redundant control over the movement of the shutter bar 56, thereby to prevent the printing of unaccounted postage even in the event of failure of the interposer 65. In the system disclosed in U.S. Pat. No. 4,287,825, the auxiliary interposer 66 was controlled by control of the digit stepper motor 10, and the carriage positions stepper motor 92, so that the interposer 66 could only be withdrawn to permit movement of the shutter bar at a "home" position of the master gear 12, as controlled by the carriage 13, and the stepping of the master gear to a determined position. This form of control for the auxiliary interposer is satisfactory when the stepper motors are under direct control of the micromputer, i.e., when it is not possible to directly control the stepper motors from outside of the secure housing.

In the arrangement of the present invention, however, as is apparent in FIG. 2, it is quite possible to step the stepper motors from an external power source, since the connectors 91 and 93 are externally available. It is thus aparent that control of the auxiliary interposer 66 by the stepper motors would enable the release of the interposer independently of the control by the microprocessor 85 of FIG. 2. Thus, for proper operation, the stepping of the stepping motors by the external electrical power pack 90 should be positively under control of the computer 85, for example, by control lines extending through an optical coupler 96 and removable connector 97 ensuring isolation of the microcomputer from electrical interference. In the event of failure of the main interposer 65, then the redundancy of control of the shutter bar 56 would be lost, since it would be possible to step the stepping motors 10 and 92 to release the interposer 66, and hence to release the shutter bar and thereafter print postage without ensuring the accounting thereof.

In accordance with the invention, the redundancy of control over operation of the shutter bar is retained, even though the stepper motors can be directly stepped by an external power pack, by controlling the auxiliary interposer 66 directly by the microcomputer. As further illustrated in FIG. 2, the microcomputer 85 within the secure housing 84 is connected by way of an interface 100 to control a solenoid 101. The clapper 102 of the solenoid extends to bridge a portion of the interposer 66. As a consequence, the interposer 66 is directly controlled by the microcomputer program within the secure housing, completely independently of the signals that may be externally applied to the digit stepping motor 10 and carriage stepping motor 92. As a result, the redundant control of the shutter bar 56 is not lost when the connectors 91 and 93 are disconnected to enable application of control voltages to the stepping motors 10 and 92.

Figure 3:
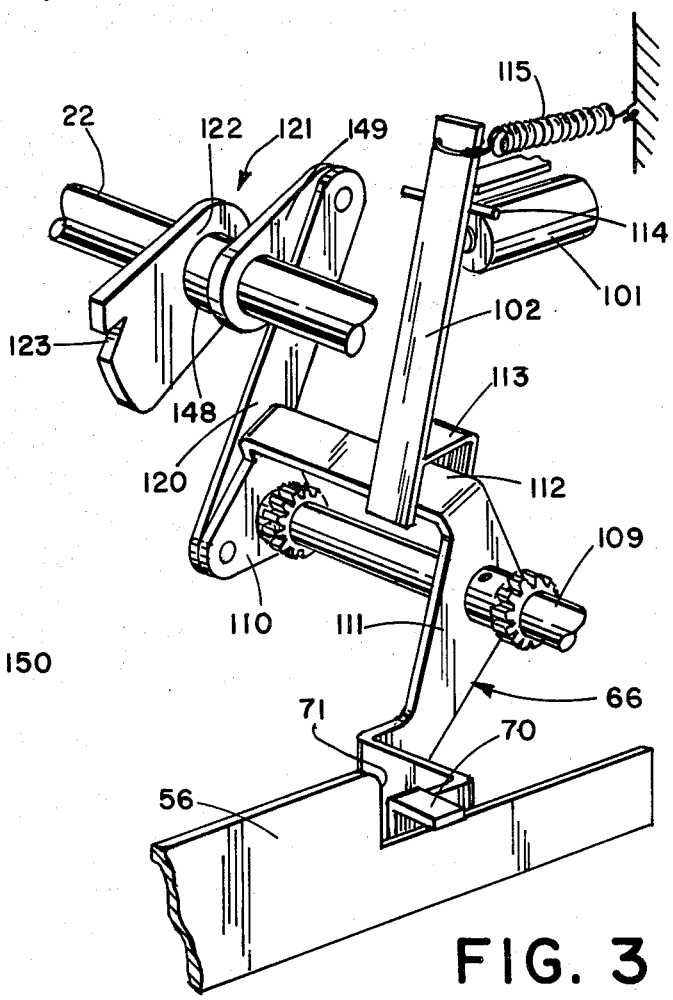
FIG. 3 is a perspective view of the auxiliary interposer and associated components, in accordance with the invention.

The interaction between the solenoid 101 and the interposer 66 is more clearly shown in FIG. 3, wherein the interposer 66 is a bail shaped member having first and second arms 110 and 111 pivotably mounted on shaft 109 (which is an extension of shaft 11) joined by a straight section 112 extending parallel to the shaft 109. An extension 70 of the arm 111 is provided to block the movement of the shutter bar 56. The clapper 102 of the solenoid has a fork shaped end 113 engaging the straight section 112 of the interposer, the other end of the clapper being resiliently held against a fulcrum 114 by a spring 115. The spring 115 thus holds the clapper away from the core of the solenoid 101, so that energization of the solenoid effects the clockwise movement of the interposer 66 about the axis of shaft 109, to remove the extension 70 from the shutter bar 56. As a consequence, it is apparent that microcomputer systems within the secure housing may control the operation of the interposer 66.

In addition to enabling control of the interposer 66 by the internal microcomputer of the postage meter, it is also necessary to inhibit movement of this interposer away from its blocking position unless the master gear 12 is at its "home" position with all of the setting wheels locked in position. For this purpose, as illustrated in FIG. 3, a link 120 is pivoted to the arm 110 of the interposer 66, the other end of this link 120 being pivoted to a cam lock member 121 rotatably mounted on the shaft 22. The cam lock member 121 has a cam lock extension 122 with a notch 123. As illustrated in FIG. 1, the carriage 13 has a notch 130 that is aligned with the cam lock extension 122 at the "home" position of the carriage. At this position of the carriage, the cam lock extension is free to be rotated through the notch 130. The carriage may hence not be moved from the "home" position unless the cam lock extension 122 is rotated to clear the notch 130. Since the cam lock extension 122 is rotatably controlled by the interposer 66 and hence by the solenoid 101, the cam lock thus permits movement of the master gear 12 to positions to set the print wheels only when interposer 66 blocks the shutter bar for redundant control thereof.

Figure 4:
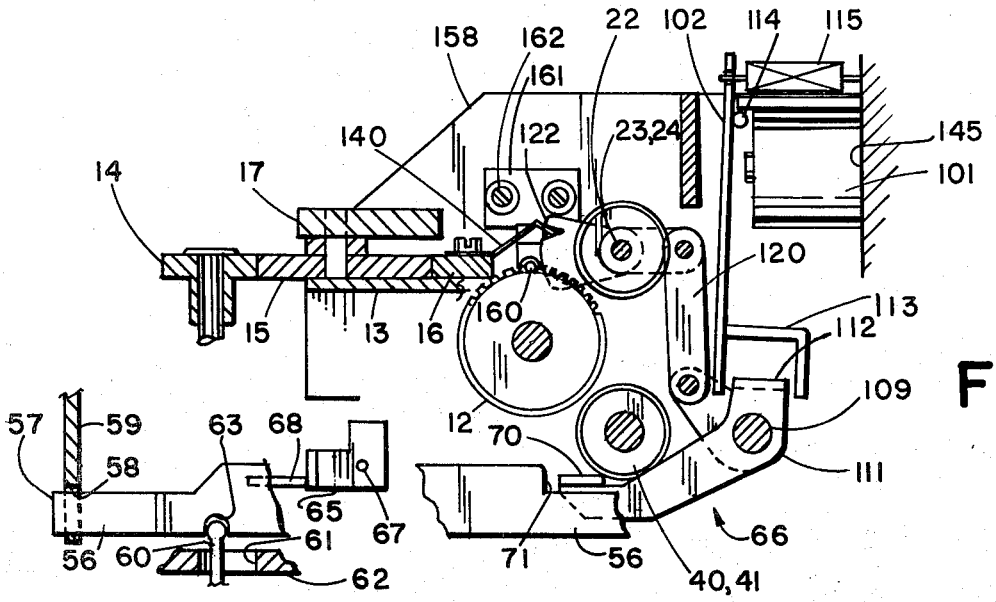
FIG. 4 is a cross-sectional view of the printing control system in accordance with the invention, taken in a plane perpendicular to the axis of the master gear.

When the interposer 66 is in blocking position, the carriage 13 may thereby be moved to enable setting of the print wheels. Upon the initial movement of the carriage from the home position, the cam lock extension 122 is prevented from movement by the tooth profile 51 adjacent the notch 130 on the carriage. As a consequence, when the carriage is not in the "home" position, the cam lock extension 122 blocks any movement of the interposer 66, so that the microcomputer has no control over unlocking this interposer unless the carriage is in its "home" position. In order to inhibit this rotation of the cam lock for greater axial movements of the carriage, an interposer 140 mounted on the carriage 13 is engageable with the notch 123 of the cam lock. As illustrated in FIG. 4, the solenoid 101 may be mounted on a wall 145 of the housing.

Figure 5:
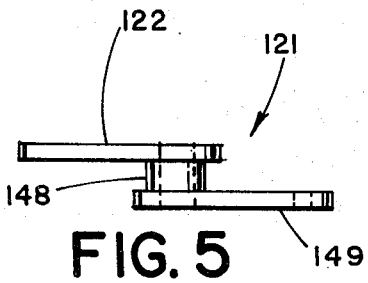
FIG. 5 is a top view of a cam lock.
Figure 6:
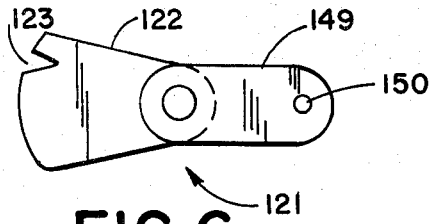
FIG. 6 is a side view of the cam lock of FIG. 5.

One embodiment of the cam lock member 121 is more clearly shown in FIGS. 5 and 6, wherein the cam lock extension 122 is affixed to one side of a central collar 148. An arm 149 is affixed to the other side of the collar, this arm 149 having an aperture 150 adapted to be pivotally affixed to the link 120 of FIG. 3.

In accordance with a further feature of the invention, as illustrated in FIGS. 1 and 4, an aligning and locking pin 160 on a bracket 161 is mounted on the side frame 158, for example by means of screws 162, the pin 160 being positioned to extend between the teeth of the master gear 12 when the master gear is in its home position. This pin 160 consequently aligns the master gear accurately, to insure that the stepper motor in the home position is correctly and accurately aligned. If the master gear is not thus aligned, then misalignment of the stepping motor, resulting, for example, from dropping of the postage meter, could possibly result in the teeth of the master gear 12 and setting gear 20 to be so far out of line they would not mesh and therefore would jam. By holding the teeth of the master gear firmly at a fixed and properly aligned position, in the home position, it is thus insured that the stepping motor correctly starts from the the home position, and that misalignment of the stepping motor from dropping or the like is inhibited.

Figure 7:
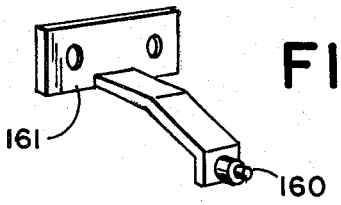
FIG. 7 is a perspective view of the alignment pin elements in accordance with the invention.

One embodiment of the alignment and blocking pin members 160–161 is illustrated more clearly in FIG. 7, although it will be apparent that other forms of this element may be advantageously employed.

As discussed above with reference to FIG. 1, the first interposer 65, cooperating with shoulder 68 of the shutter bar is also controllable to inhibit movement of the shutter bar 56 from its blocking position. This interposer is employed in order to inhibit release of the shutter bar for a printing operation unless all operations within the postage meter are correct. For example, as disclosed in U.S. Pat. No. 4,301,507, the postage meter includes a printing system and an accounting system with separate microprocessors, each of the microprocessors being connected to block the release of a shutter bar in the event of errors or malfunctioning of the postage meter. For example, the shutter bar could not be released under low voltage condition or if the program indicated other error conditions. The interposer 65 may hence be controlled in a similar fashion, for example, as illustrated in FIG. 2 by the microcomputer 85, by way of an interface 180 and solenoid 181. The control of the interposer 65 is different from the control of the interposer 66, in that the interposer 65 locks the movement of the shutter bar in the event of incorrect operating conditions or failure, whereas the interposer 66 locks the shutter bar unless the carriage is in the "home" position, and the microcomputer program permits a printing operation to occur.

While the invention has been disclosed and described with reference to a single embodiment it will be apparent tha variations and modifications may be made therein, and it is therefore intended in the following claims to cover each such variation and modification which falls within the true spirit and scope of the invention.

I claim:

1. In an electronic postage meter including a printer, a setting mechanism for setting the printer, and an electronic accounting and control system connected to control the setting mechanism, wherein the setting mechanism includes a shutter bar movable into and out of a position to block operation of the printer, and first and second interposers positioned to selectively block the shutter bar, said electronic accounting and control system being connected to control said first interposer to block said shutter bar in the event of incorrect operating conditions or failure in the postage meter; the improvement comprising means coupled to said electronic accounting and control system for controlling the position of said second interposer to enable blocking of said shutter bar in accordance with a program of said control system independently of said setting mechanism; said setting mechanism having a first position at which said printer cannot be set and at least one other position at which said printer can be set, and lock means inhibit the release of said second interposer at said other position or position of said setting mechanism.

2. The electronic postage meter of claim 1 wherein said second interposer comprises bail means, said means for controlling the position of said second interposer comprising a solenoid connected to be controlled by said electronic and control systems, said solenoid having clapper means mounted to control the position of said second interposer.

3. The electronic postage meter of claim 2 wherein said setting mechanism comprises a plurality of setting gears for controlling separate printing wheels of said printer, a master gear, first stepping means for rotating said master gear, and second stepping means for moving said master gear into and out of engagement with said setting gears, said lock means being mounted to inhibit release of said second interposer when said master gear is aligned with any of said stepping gears, and to inhibit movement of said second stepping means when said second interposer is released.

4. The electronic postage meter of claim 3 wherein said first stepping means comprises a stepper motor, and said second stepper means comprises a second stepper motor and a carriage stepped thereby, said carriage being mounted to selectively move said master gear to said first and other positions.

5. The electronic postage meter of claim 4 further comprising means aligning said master gear at a given angular displacement when said setting mechanism is in said first position.

6. The electronic postage meter of claim 5 wherein said aligning means comprises a pin extending axially to engage the teeth of said master gear only in said first position.

7. The electronic postage meter of claim 1 wherein said electronic accounting and control system comprises a microcomputer accounting and control system.

8. In a printing control system for a printer having at least one print wheel, a movable element for effecting printing by said printer, a master gear mounted in a carriage, a separate setting gear coupled to control each said print wheel, first stepping means for rotating said master gear, second stepping means for selectively moving said carriage to a first position with the master gear out of engagement with said setting gears and other positions with said master gear engaging one of stepping gears, and shutter means movable to enable and inhibit movement of said moveable element; the improvement comprising an interposer moveable into a position blocking said shutter means from enabling movement of said moveable element, electrical control means connected to control said interposer in accordance with a program of said control means and independently of the rotational positions of said master gear; and lock means coupled to said interposer to inhibit release thereof at said other position of said master gear, and to inhibit movement of said carriage from said first position when said interposer is released from blocking said shutter means.

9. The printing control system of claim 8 wherein said interposer comprises a bail, said electrical control means comprises solenoid means mounted to selectively position said bail, and said lock means comprises a cam mounted to be rotated by said bail and cooperatively positioned with respect to said carriage.

10. The printing control system of claim 9 wherein said carriage has a slot permitting rotation of said cam once said master gear is in said first position and locking said cam at a position to hold said interposer in locking position at said other positions of said master gear.

11. The printing control system of claim 8 comprising an additional interposer mounted to selectively block movement of said shutter means, and electrical control means for controlling said additional interposer.

12. The printing control system of claim 8 further comprising a fixed alignment pin positioned to engage teeth of said master gear at said first position thereof, whereby said master gear is held from rotation at a determinable angular displacement at said first position.

13. The printing control system of claim 8 wherein said moveable element comprises a gear, said print wheels being mounted on a printing drum for rotation by said rotatable gear, said shutter means comprising a shutter bar moveable into and out of blocking engagement with said rotatable gear.

14. The printing control system of claim 13 wherein said interposer comprises a bail, and said block means comprises a cam lock and link means coupled to said bail for moving said cam lock into and out of blocking engagement with said carriage.

* * * * *